United States Patent [19]

Suzuki

[11] 4,261,170

[45] Apr. 14, 1981

[54] EXHAUST-GAS PURIFIER

[75] Inventor: Motoo Suzuki, Kyoto, Japan

[73] Assignee: Mitsubishi Jidosha Kogyo Kabushiki Kaisha, Tokyo, Japan

[21] Appl. No.: 942,146

[22] Filed: Sep. 14, 1978

[30] Foreign Application Priority Data

Sep. 26, 1977 [JP] Japan ..... 52-115700
Jul. 25, 1978 [JP] Japan ..... 53-91072

[51] Int. Cl.[3] ..... F01N 3/15
[52] U.S. Cl. ..... 60/302; 422/180
[58] Field of Search ..... 60/302, 299; 422/180, 422/196, 176

[56] References Cited

U.S. PATENT DOCUMENTS

| | | | |
|---|---|---|---|
| 3,065,595 | 11/1962 | Gary | 60/299 |
| 3,109,715 | 11/1963 | Johnson | 60/299 |
| 3,166,895 | 1/1965 | Slayter | 60/299 |
| 3,441,381 | 4/1969 | Keith | 60/302 |
| 4,096,691 | 6/1978 | Nohira | 60/302 |
| 4,117,675 | 10/1978 | Tanaka | 60/302 |
| 4,182,120 | 1/1980 | Niebylski | 60/299 |

FOREIGN PATENT DOCUMENTS

| | | | |
|---|---|---|---|
| 2345383 | 3/1975 | Fed. Rep. of Germany | 60/302 |

*Primary Examiner*—Douglas Hart
*Attorney, Agent, or Firm*—Robert E. Burns; Emmanuel J. Lobato; Bruce L. Adams

[57] ABSTRACT

An exhaust-gas purifier comprising a monolithic catalyst which is disposed in an exhaust passage of an engine proper provided with a plurality of cylinders, and which has a plurality of paths running in the direction of the exhaust-gas stream, wherein the exhaust passage is divided into a plurality of passageways opening close to the upstream end of the monolithic catalyst, the passageways being independent from each other or combined with proper others so as to form compound passageways. The part of the independent exhaust passageways corresponding to each cylinder or compound passageways is extended to the downstream end of the monolithic catalyst, substantially separated from each other, thus lowering the interference of each cylinder due to fluctuation of the exhaust pressure exerting adverse effects on each other.

5 Claims, 23 Drawing Figures

EXHAUST-GAS PURIFIER

FIELD OF INVENTION

This invention relates to an exhaust-gas purifier comprising a catalytic converter disposed in the exhaust system of a multicylinder engine with a plurality of cylinders.

BACKGROUND OF THE INVENTION

To raise the purifying efficiency of a catalytic converter, high-temperature exhaust gas must be supplied to it. To make such supply possible, the catalytic converter should preferably be provided in the exhaust-gas passage near the engine proper.

At the same time, the exhaust-gas passage of each cylinder should preferably be formed as long as possible and separated from the exhaust-gas passages of the other cylinders, in order to prevent the pulsating exhaust pressure of each cylinder from interfering with the exhaust stroke of the other cylinders.

SUMMARY OF THE INVENTION

This invention relates to an exhaust-gas purifier comprising a catalytic converter disposed in the exhaust system near the engine proper, with the individual exhaust-gas passages being formed as long as possible and separated from each other. This invention was achieved by noting that a monolithic catalyst comprises a catalytic metal supporting structure that is divided into multiple, independent, small paths open-ended on both the upstream and downstream sides and passing through the direction of the gas flow, and especially that the multiple small paths do not communicate with each other. The multiple paths of the monolithic catalyst are divided into several groups so that each group forms a portion of each independent exhaust-gas passage. This invention provides an exhaust-gas purifier comprising an engine proper having a plurality of cylinders, an exhaust-gas passage to discharge the exhaust gas from said cylinders into the atmosphere, and a monolithic catalyst that has multiple independent paths running in the direction of the exhaust-gas flow and is disposed in said exhaust-gas passage, wherein at least that end of said exhaust-gas passage which is upstream of said monolithic catalyst is divided into a plurality of paths opening in the vicinity of the upstream end of said monolithic catalyst.

According to this invention, therefore, the multiple, independent, small paths in the monolithic catalyst function in conjunction with the plurality of divided exhaust-gas passages upstream of said converter, as the extensions of the individual exhaust-gas passages. This results in forming substantially long exhaust-gas passages, which reduces interference by the pulsating exhaust-gas pressure and permits placing said monolithic catalyst in the exhaust-gas passage near the engine proper. Consequently, this invention can provide a compact exhaust-gas purifier with high purifying efficiency.

Now embodiments of this invention will be described by reference to the accompanying drawings in which.

Figure 1:
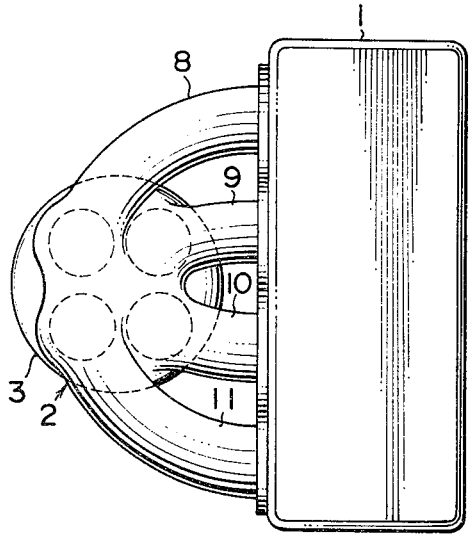
FIG. 1 is a plan view showing a first embodiment of this invention.
Figure 2:
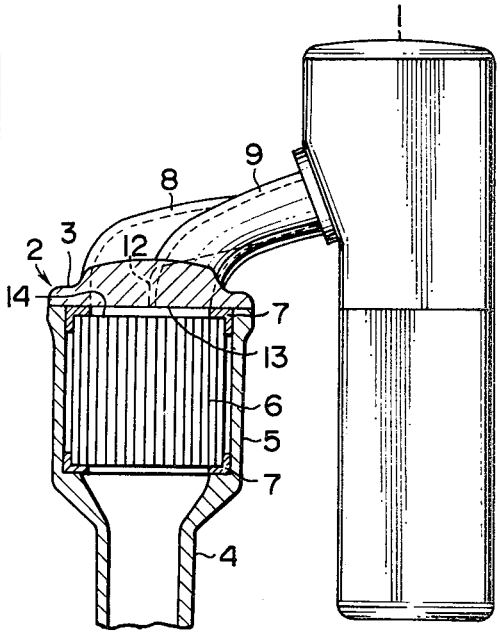
FIG. 2 is a side cross-sectional view of the same embodiment.

Referring to FIGS. 1 and 2, an exhaust manifold 2, connected to one end of an in-line 4-cylinder engine proper 1, is bisected into an upper pipe 3 and a lower pipe 4. A cylindrical converter casing 5 is formed upstream of the lower pipe 4, and said casing 5 carries inside a monolithic catalyst 6, with both ends thereof being held by cushion rings 7.

The monolithic catalyst 6 is permeable only axially, with its pemeation cells being arranged like a honeycomb in cross section.

The upper pipe 3 of the exhaust manifold 2 is divided into four pipes that are connected to the exhaust ports of the four cylinders (not shown) of the engine proper 1, thus forming independent exhaust passages 8, 9, 10 and 11. The exhaust passages 8, 9, 10 and 11 are completely separated from each other by a partition wall 12 down to a plane 13 where the upper pipe 3 meets the lower pipe 4. In this meeting plane 13, the individual lines open close and opposite to the top surface 14 of the monolithic catalyst 6.

In this embodiment, a small space of approximately 5 mm is left between the meeting plane 13 and the top surface 14 of the monolithic catalyst 6.

Provision of this small space is based on considerations for the cost and thermal resistance of the purifier. Preferably it should not be too large for the reason given later.

With this structure, exhaust gas emitted from the cylinders passes through the separated exhaust passages 8, 9, 10 and 11 to the monolithic catalyst 6. After being thoroughly purified in the monolithic catalyst 6, the gas flows further through the lower pipe 4 and an exhaust muffler (not shown) into the atmosphere. Independently flowing substantially to the lower end of the monolithic catalyst 6, the gas streams from the cylinders are not mixed together until they leave the monolithic catalyst 6. This reduces the exhaust interference between the cylinders and enhances the power producing efficiency of the engine.

So far as said space between the meeting plane 13 and the top surface 14 is held within a little or no more than approximately 5 mm, pressure pulsation causing exhaust interference is negligible. In other words, exhaust interference through this space is so limited that little output drop will result.

With the conventional catalyst in general, a misfire might cause such troubles as breakage of the catalyst, impairment of its function, and burning of the involved area. In the above-described embodiment of this invention, by contrast, a large quantity of rich unburned gas from a misfiring cylinder and exhaust gas, containing high-temperature residual oxygen, normally burned in the combustion chambers of the other cylinders pass through the monolithic catalyst 6, scarcely mixed with each other. Therefore, afterburn is prevented and said troubles decrease.

The troubles due to afterburn decrease remarkably in a system in which no secondary air is supplied upstream of the monolithic catalyst 6.

Figure 3:
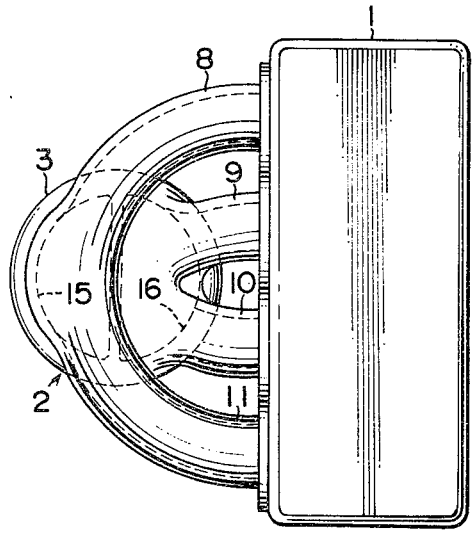
FIG. 3 is a plan view showing a modified example of the first embodiment.

FIG. 3 shows a modification of the above-described first embodiment, in which those of the exhaust passage 8 to 11, forming part of the upper pipe 3, which are more related with each other in respect of exhaust interference of pulsation, namely, the exhaust passages 8 and 11, and 9 and 10, are grouped together to form compound passages 15 and 16, respectively. As in the above-described first embodiment, the compound passages 15 and 16 separately open in the meeting plane 13, close and opposite to the top surface of the monolithic catalyst 6.

In this modified embodiment, pulsating exhaust-gas pressures of the exhaust passages 8 and 11, and 9 and 10, affect each other. Owing to the synchronizing action of the vacuum wave and valve overlap period, however, volumetric efficiency of the air-fuel mixture is enhanced to increase power output.

Exhaust interference, if any, might adversely affect the volumetric efficiency. Actually this modified embodiment has little such effect, the compound passages 15 and 16 continuing separated from each other substantially to the rear end of the monolithic catalyst 6.

Figure 4:
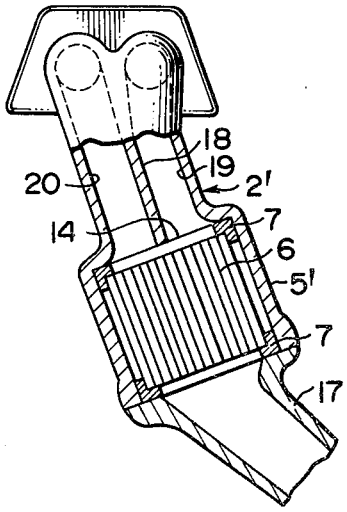
FIG. 4 is a cross-sectional view showing the principal part of a second embodiment of this invention.

In the foregoing first embodiment and its modification, this invention is adapted to a 4-cylinder engine. It is also advantageously applicable to such 2-, 3-, 6-, 8-cylinder and other multicylinder internal-combustion engines. Now a second embodiment in which this invention is applied to a 2-cylinder engine will be described by reference to FIG. 4. An exhaust manifold 2', connected to one end of a 2-cylinder engine not shown, contains a monolithic catalyst 6, and an exhaust pipe 17 is connected to the lower end of said exhaust manifold 2'.

In the downstream end of the exhaust manifold 2' is formed a cylindrical converter casing 5' to contain said monolithic catalyst 6 supported by cushion rings 7.

Upstream of the exhaust manifold 2' are formed two independent exhaust passages 19 and 20 separated by a partition wall 18, the upstream ends thereof individually communicating with the not-shown two cylinders and the downstream ends separately opening close and opposite to the top surface 14 of the monolithic catalyst 6.

Like the first embodiment on the 4-cylinder engine, this second embodiment can increase power output, by enhancing the volumetric efficiency of the air-fuel mixture and prevent afterburn.

Figure 5:
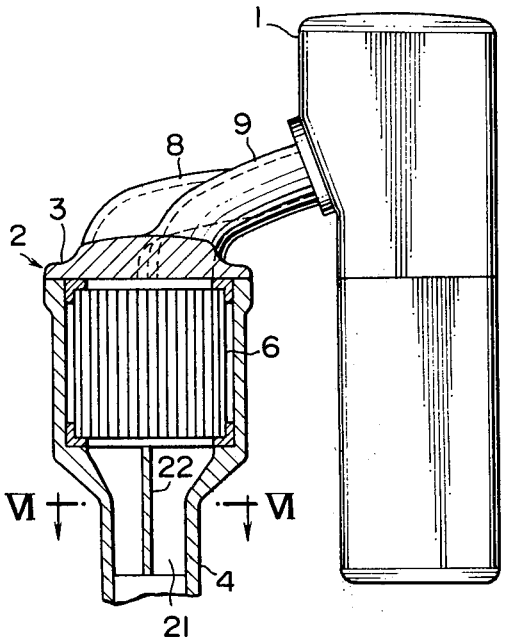
FIG. 5 is a side corss-sectional view showing another modified example of the first embodiment.
Figure 7:
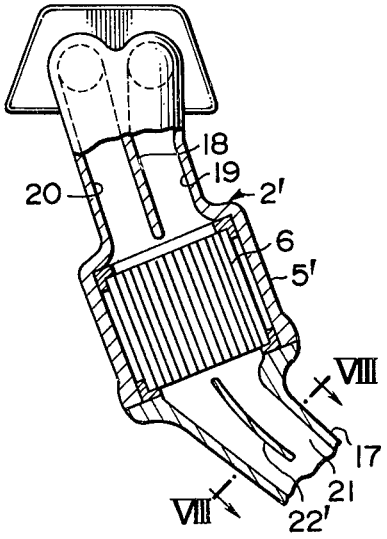
FIG. 7 is a cross-sectional view showing the principal part of a modified example of the second embodiment.
Figure 6:
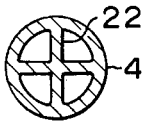
FIG. 6 is a cross-sectional view looking in the direction of the arrow VI—VI of FIG. 5.
Figure 8:
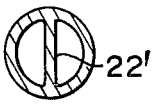
FIG. 8 is a cross-sectional view looking in the direction of the arrow VIII—VIII of FIG. 7.

FIGS. 5 and 6 show another modification of the first embodiment, and FIGS. 7 and 8 a modification of the second embodiment.

In these modified embodiments, an exhaust passage 21 downstream of the monolithic catalyst 6 is divided into a plurality of independent paths continuing to a given downstream position, separated by a partition wall 22 in one and 22' in the other. By this means, the independency of said exhaust passages 8, 9, 10 and 11, or 19 and 20, is extended through the monolithic catalyst 6 to a given position of the exhaust passage 21 downstream of said catalyst 6.

With such structure, these two modified embodiments decrease exhaust interference of pulsation to greater extents.

FIGS. 9 through 20 show a third embodiment of this invention. Reference numeral 102 comprehensively denotes a 4-cylinder engine with the first to fourth cylinders 104, 106, 108 and 110. The cylinder head 112 contains an exhaust system 114 to discharge into the atmosphere exhaust gases emitted from the exhaust ports of the individual cylinders.

Figure 9:
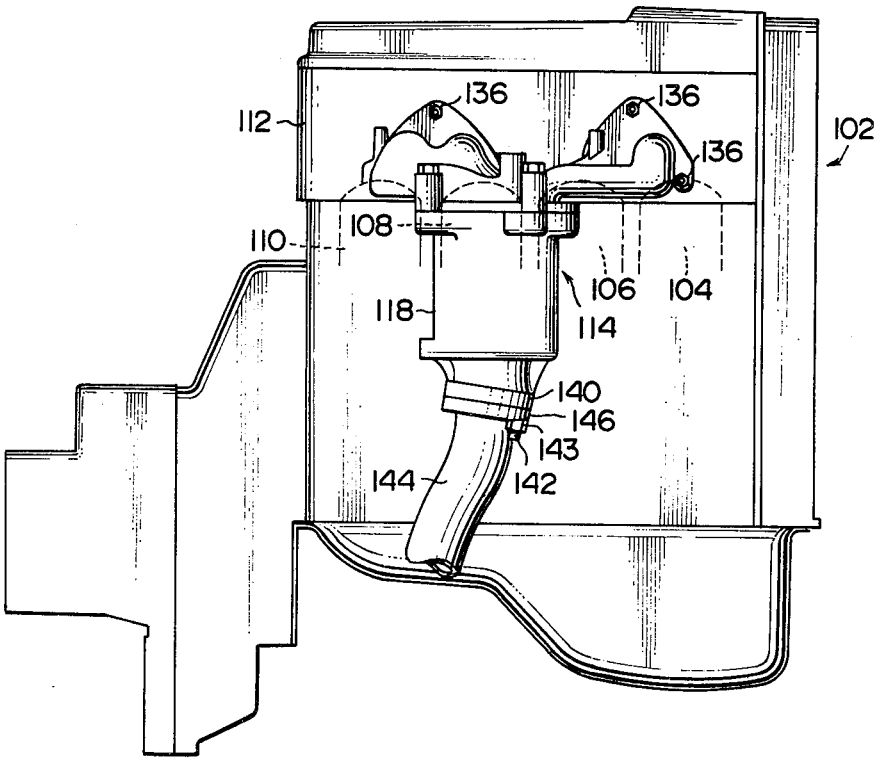
FIG. 9 is a front view showing a third embodiment of this invention.
Figure 11:
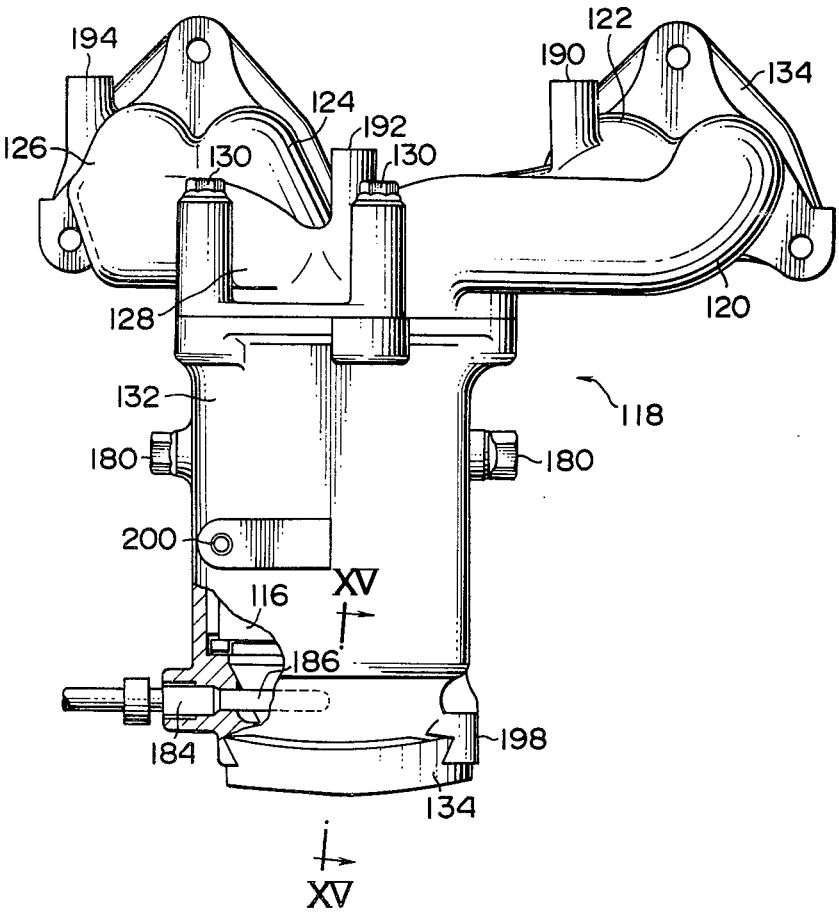
FIG. 11 is a front view of a catalytic converter in the third embodiment.
Figure 12:
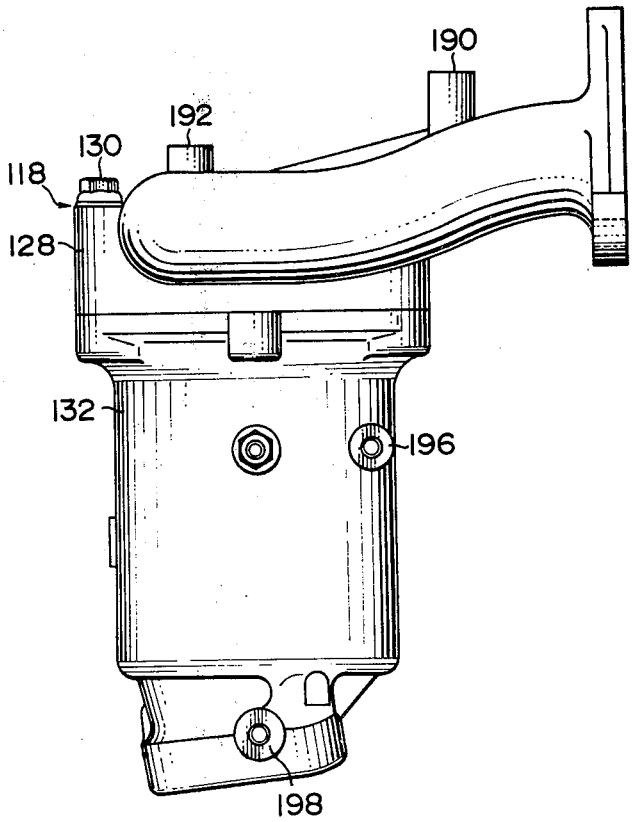
FIG. 12 is a side elevation similar to FIG. 11.
Figure 13:
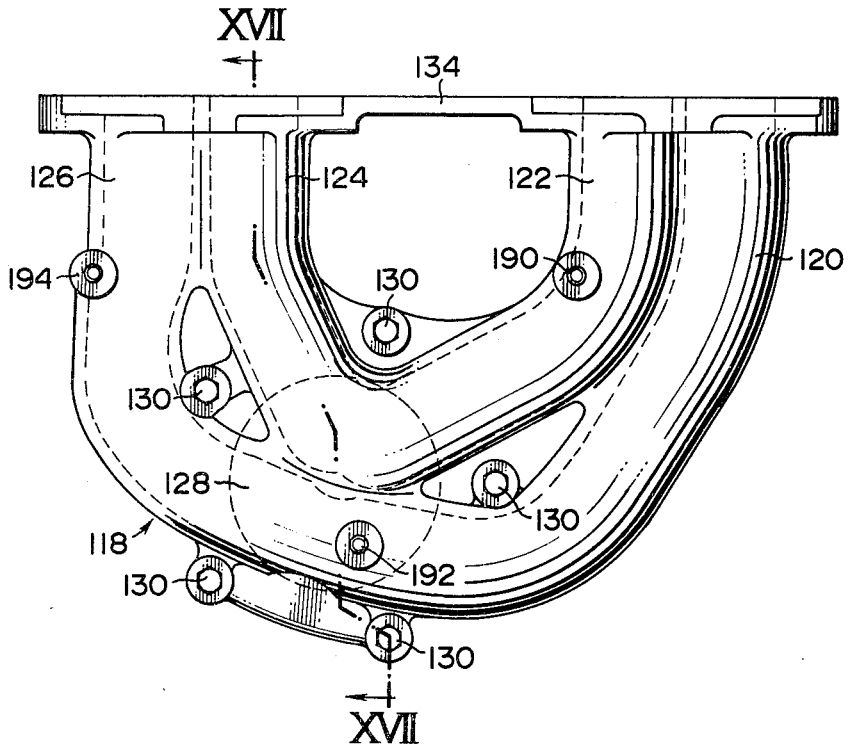
FIG. 13 is a plan view similar to FIG. 11.
Figure 14:
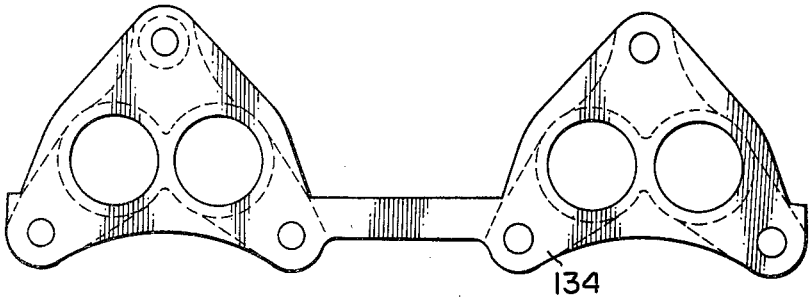
FIG. 14 is a partial rear view similar to FIG. 11.
Figure 15:
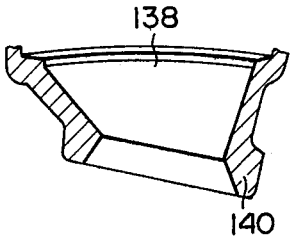
FIG. 15 is a cross-sectional view looking in the direction of the arrow XV—XV of FIG. 11.
Figure 16:
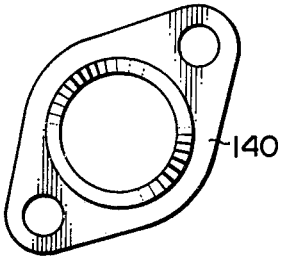
FIG. 16 is a bottom view similar to FIG. 15.

The exhaust system 114 has a catalytic converter 118 containing a monolithic catalyst 116. As shown in FIGS. 9, 11 and 13, this catalytic converter 118 has an exhaust manifold 128 having a first passageway 120 communicating with the first cylinder 104 of the 4-cylinder engine 102, a second passageway 122 with the second cylinder 106, a third passage-way 124 with the third cylinder 108, and a fourth passage-way 126 with the fourth cylinder 110. A case 132 is fixed to the exhaust manifold 128 with a plurality of bolts 130. The exhaust manifold 128 and case 132 are both made of casting. The exhaust manifold 128 is fixed to the cylinder head 112 with bolts 136, at a flange 134 connecting the passageways 120, 122, 124 and 126. The case 132 is fixed to an exhaust pipe 144 by putting together a flange 140 formed around a downstream exhaust outlet 138 and flange 146 with stud bolts 142 and nuts 143, as shown in FIG. 9.

Figure 17:
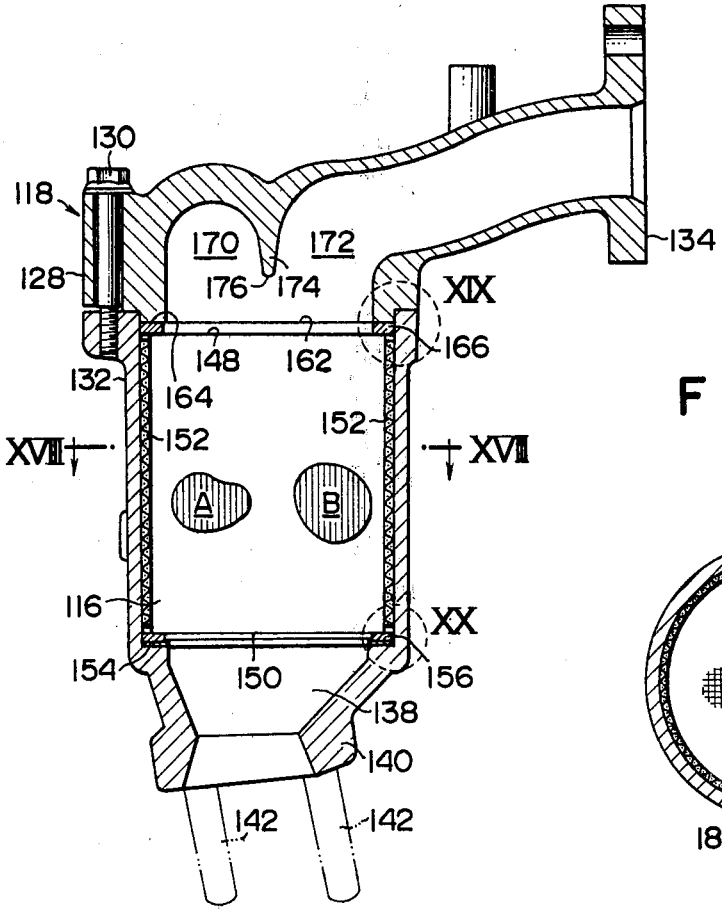
FIG. 17 is a cross-sectional view looking in the direction of the arrow XVII—XVII of FIG. 13.
Figure 18:
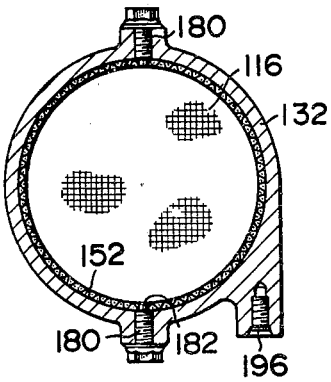
FIG. 18 is a cross-sectional view looking in the direction of the arrow XVIII—XVIII of FIG. 17.
Figure 19:
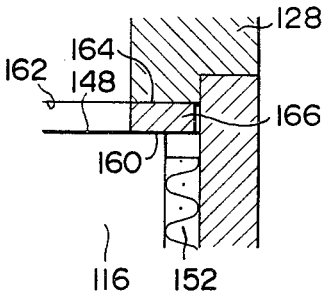
FIG. 19 is an enlarged view showing part XIX of FIG. 17.
Figure 20:
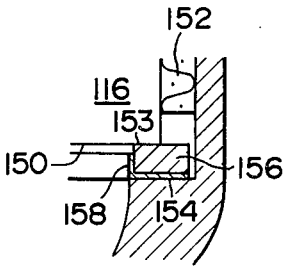
FIG. 20 is an enlarged view showing part XX of FIG. 17.

As shown in FIGS. 17 and 18, the monolithic catalyst 116 is cylindrical and comprises a catalytic metal carried by a substrate. The substrate consists of many small, independent, open-ended paths continuing between the upstream end 148 and the downstream end 150. The paths are separated by thin walls so as not to communicate with each other. Wrapped outside with an elastic member 152 of knitted wire mesh, the monolithic catalyst 116 is placed in the case 132. The elastic member 152 allows radial deformation due to mechanical shock or thermal expansion. Between the circumferential edge 153 of the downstream end 150 of the monolithic catalyst 116 and the annular seat surface 154 projecting inward in the lower portion of the case 132 are inserted an elastic ring member 156 and a protector 158 covering part of the internal surface and the bottom of said elastic ring member 156, as shown in FIG. 20. Likewise, an elastic ring member 166 of knitted wire mesh is interposed between the circumferential edge 160 of the upstream end 148 of the monolithic catalyst 116 and the annular seat surface 164 projecting inward in the downstream opening 162 of the exhaust manifold 128, as shown in FIG. 19. By putting together the exhaust manifold 128 and the case 132 with bolts 130, the elastic ring members 156 and 166 are pressed through the monolithic catalyst 116 against the respective annular seat surfaces 154 and 164 with suitable fastening pressure.

The elastic member 152 cylindrically wound around the monolithic catalyst 116 is, for example, formed by 0.25 mm dia. stainless steel wires cylindrically knitted and waved. The elastic ring members 156 and 166 between the upstream and downstream ends 148 and 150 of the monolithic catalyst 116 and the annular seat surfaces 154 and 164, respectively, are, for example, formed by 0.15 mm dia. stainless steel wire knitted into a ring and compressed.

Next, the construction of the exhaust manifold 128 will be described by reference to FIGS. 13 and 17. The first passageway 120 and the fourth passageway 126 combine to form a first compound passageway 170, whereas the second passageway 122 and the third passageway 124 form a second compound passageway 172. The two compound passageways 170 and 172 are substantially separated from each other by a partition-wall member 174 of the exhaust manifold 128, opening in the vicinity of the upstream end 148 of the monolithic catalyst 116. The lower end 176 of the partition-wall member 174 should preferably be brought as close as possible to the upstream end 148 of the monolithic catalyst 116, not exceeding the limit that they come in contact when the latter deforms under the influence of thermal expansion or shock. Even with a space of, for example, 15 to 30 mm, however, interference between the two compound passageways 170 and 172 due to pulsating exhaust pressure is negligible.

As shown in the plan view of FIG. 13, the bolts 130 combining the exhaust manifold 128 and the case 132 are located substantially at the apexes of a regular pentagon.

As shown in FIGS. 11, 17 and 18, lock bolts 180 are screwed from outside the case 132, each bolt having a point 182 projecting inside the case 132. Thrusting into the elastic member 152 outside the monolithic catalyst 116, the point 182 prevents the rotation of the elastic member 152, thereby also preventing the rotation of the monolithic catalyst 116 engaging with the elastic member 152 with great frictional force.

Figure 10:
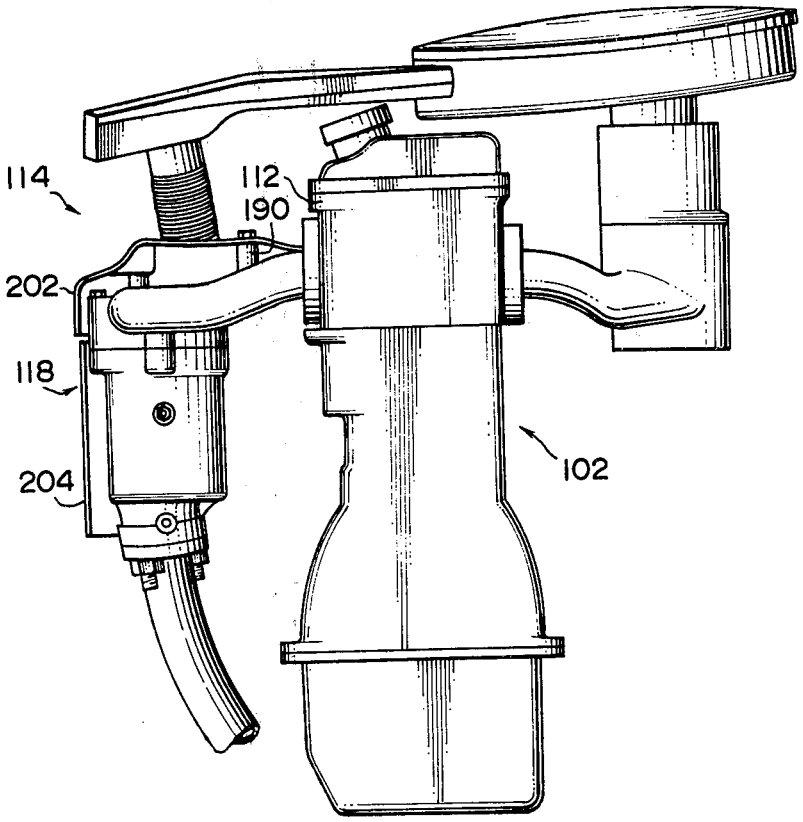
FIG. 10 is a side elevation showing the third embodiment.

As particularly well shown in FIG. 1, a temperature detector 184 having an inward-projecting temperature sensor 186 is provided in the exhaust gas outlet 138 of the case 132. Connected to an alarm device not shown, the temperature detector 184 detects abnormal overheating of the catalytic converter 118, and gives an alarm as required. In FIGS. 10 and 11, reference numerals 190, 192, 194, 196, 198 and 200 designate bolt seats for fixing heat shields 202 and 204 to the exhaust manifold 128 and the case 132.

Now the operation and result obtained with this embodiment having the above-described structure will be described. The 4-cylinder engine 102 becomes ignited in the order of the first cylinder 104, second cylinder 106, fourth cylinder 110 and third cylinder 108. Consequently, the four cylinders undergo the exhaust stroke, and therefore supply the exhaust gas to the catalytic converter assembly 118, in the same order. The first passageway 120 communicating with the first cylinder 104 and the fourth passageway 126 communicating with the fourth cylinder 110 join into the first compound passageway 170 defined by the partition-wall member 174 of the exhaust manifold 128, whereas the second passageway 122 communicating with the second cylinder 106 and the third passageway 124 communicating with the third cylinder 108 join into the second compound passageway 172 defined by said partition-wall member 174. These two compound passageways 170 and 172, separated from each other, open close to the upstream end 148 of the monolithic catalyst 116. Accordingly, as shown in FIG. 17, the multiple small paths of the monolithic catalyst 116 are divided into a small paths group A, communicating with the first compound passageway 170 and functioning as the extension thereof, and a small paths group B, communicating with the second compound passageway 172 and functioning at the extension thereof.

Therefore, the first compound passageway 170 and the small paths group A of the monolithic catalyst 116 form a substantially continuous exhaust-gas passage, so that exhaust gases in the first cylinder 104 and fourth cylinder 110, free from the adverse effect of the interference due to pulsating exhaust pressures, can reduce the back pressure. Similarly, the second compound passageway 172 and the small paths group B form a substantially continuous exhaust-gas passage, so that exhaust gases in the second cylinder 106 and third cylinder 108 do not exert adverse effects on each other. As the total result, the exhaust efficiency of the 4-cylinder engine 102 is improved to increase power output and mileage. The same functional effect is also attained in another 4-cylinder engine that ignites in the order of the first, third, fourth and second cylinder.

When, for example, the first cylinder 104 of this embodiment misfires, the exhaust gas containing much unbured ingredients flows through the first passageway 120 and the first compound passageway 170 to the small paths group A of the monolithic catalyst 116. The next exhaust stroke occurs in the second cylinder 106, and the exhaust gas therefrom flows to the small paths group B of the monolithic catalyst 116. Consequently, the exhaust gas from the misfiring first cylinder 104 and the high-temperature exhaust gas from the second cylinder 106 substantially flow to the separated small paths groups A and B of the monolithic catalyst 116, whereby said exhaust gas with much unburned ingredients hardly causes afterburn. Likewise, the exhaust gas from the misfired first cylinder 104 does not cause afterburn when the exhaust gas from the fourth cylinder 110 enters the small paths group A of the monolithic catalyst 116 because the former is then being discharged into the exhaust pipe 144 through the exhaust outlet 138. All this is conducive to enhancing the durability of the exhaust system 114 including the monolithic catalyst 116.

According to this invention, further, in which the small paths groups of the monolithic catalyst 116 make up part of the independent exhaust passages, that part of the exhaust manifold 128 which constitute the independent exhaust passages can be shortened to permit installing the monolithic catalyst 116 closer to the 4-cylinder engine 102 than conventionally. This increases the gas purifying efficiency of the catalytic converter 118 and reduces the size of the exhaust-gas purifying system.

This embodiment has the elastic member 152 in the case 132 and the lock bolts 180 to prevent the rotation of the monolithic catalyst 116 through said case 132. These means prevent damaging of the monolithic catalyst 116 by rotation and thus lengthen its service life.

The monolithic catalyst 116 of this embodiment is placed in the exhaust manifold 128 and the case 132, not only enclosed by said elastic member 152 but also supported by the elastic members 166 and 156 interposed between the upstream end 148 and the downstream end 150 and the circumferential edges 160 and 153, respectively. These elastic members 166 and 156 absorb shock and thermal expansion, thereby enchancing the durability of the exhaust-gas purifying system.

Further, the protector 158 covering part of the internal surface and the bottom of said elastic member 156 at the downstream end 150 prevents burning of said elastic member 156 and thereby adds to the system durability.

Figure 21:
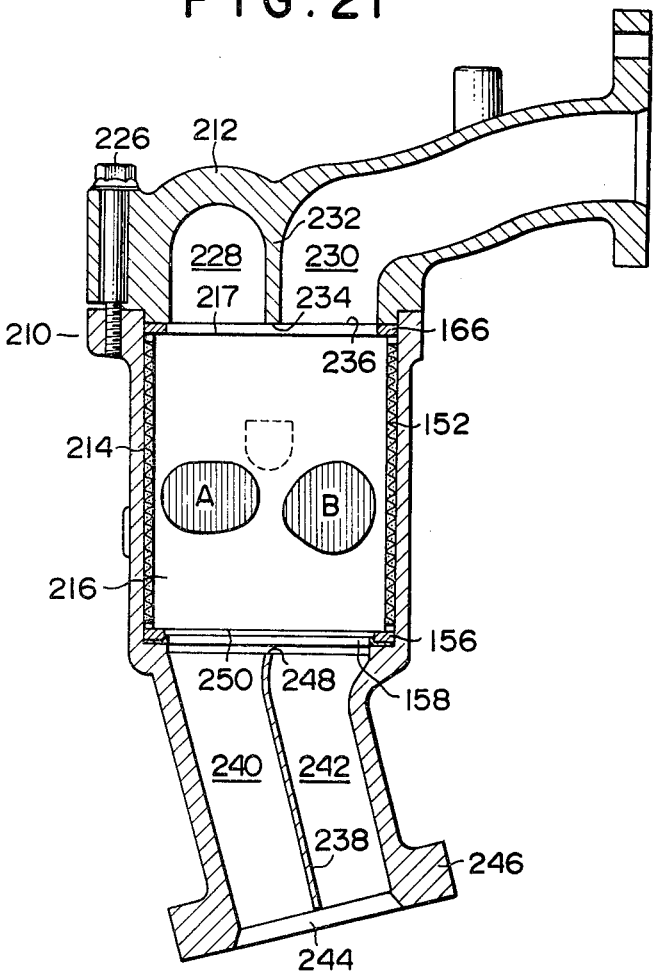
FIG. 21 is a schematic cross-sectional view of a catalytic converter in a fourth embodiment of this invention.
Figure 22:
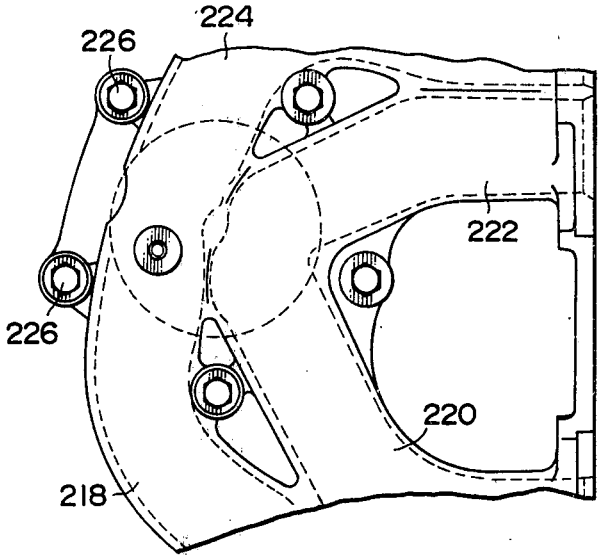
FIG. 22 is a plan view similar to FIG. 21.
Figure 23:
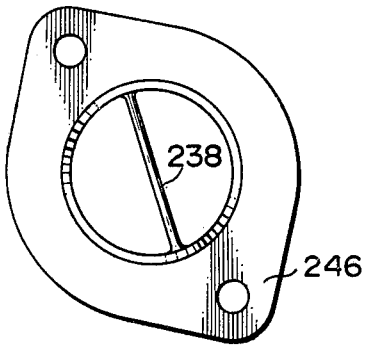
FIG. 23 is a partial bottom view similar to FIG. 21.

Next, a fourth embodiment of this invention will be described by reference to FIGS. 21 through 23.

The same of substantially the same parts and members as in the above-described third embodiment will be designated by similar reference characters, and detailed descriptions on them omitted.

Reference numeral 210 denotes a catalytic converter having an exhaust manifold 212 and a case 214 and containing a monolithic catalyst 216. The exhaust manifold 212, having a first passageway 218, a second passageway 220, a third passageway 222 and a fourth passageway 224, is fixed to the case 214 with a plurality of bolts 226.

The first passageway 218 and the fourth passageway 224 combine to form a first compound paasageway 228, whereas the second passageway 220 and the third passageway 222 combine to form a second compound passageway 230. The two compound passageways 228 and 230, separated from each other by a partition-wall member 232 of the exhaust manifold 212, open close to the upstream end 217 of the monolithic catalyst 216. The lower end 234 of the partition-wall member 232 hangs down substantially to the plane 236 where the exhaust manifold 212 meets the case 214. Downstream of the case 214 is formed an exhaust outlet 244, which is divided into a first exhaust outlet 240 and a second exhaust outlet 242 by a partition-wall member 238. As shown in FIG. 23, a flange 246 for connection with the exhaust pipe is formed around the exhaust outlet 244. The upstream end 248 of the partition-wall member 238 lies in the vicinity of the downstream end 250 of the monolithic catalyst 216.

This embodiment with the above-described structure operates as follows. The exhaust gases flowing through the first passageway 218 communicating with the first cylinder and the fourth passageway 224 communicating with the fourth cylinder are discharged through the first compound passageway 228 and the small paths group A of the monolithic catalyst 216 to the first exhaust outlet 240. The exhaust gases flowing through the second passageway 220 communicating with the second cylinder and the third passageway 222 communicating with the third cylinder are discharged through the second compound passageway 230 and the small paths group B of the monolithic catalyst 216 to the second exhaust outlet 242.

Namely, the exhaust line through the first and fourth passageways 218 and 224 continues substantially independent from the first compound passageway 228 through the small paths group A of the monolithic catalyst 216 to the first exhaust outlet 240. Likewise, the exhaust line through the second and third passageways 220 and 222 continues substantially independent from the second compound passageway 230 through the small paths group B of the monolithic catalyst 216 to the second exhaust outlet 242.

In addition to the same effect as with the third embodiment, this embodiment, with the separated exhaust passages extending to the downstream end of the case 214, can prevent interference by pulsating exhaust-gas pressure more effectively.

It is preferable that each of the exhaust manifolds 128 and 212 and the cases 132 and 214 of the above-described embodiments be integrally cast. But they may also be made in sections by stamping, such as vertically halving the case in FIG. 21, whose flanges are then joined together by welding or other suitable means.

Furthermore, suitable provision may be made in the exhaust passages upstream of the monolithic catalyst 116 and 216 to supply an appropriate quantity of secondary air.

What is claimed is:

1. An exhaust-gas purifier for an internal combustion engine having a plurality of cylinders comprising an exhaust manifold secured to said engine to receive exhaust gasses from the engine cylinders, a cylindrical casing having an upstream end secured to said exhaust manifold and a downstream end connected to an exhaust pipe, a monolithic catalyst in said casing, said catalyst having an upstream end and a downstream end and a multiplicity of independent open-ended paths extending from said upstream end to said downstream end, said paths being separated by thin walls so as not to communicate with each other, and elastic sealing means disposed between said monolithic catalyst and said casing, said exhaust manifold having a plurality of individual passageways equal in number to the number of cylinders, each of said individual passageways communicating at an upstream end with a respective engine cylinder, and a plurality of compound passageways each of which has an upstream end communicating with two of said individual passageways and a downstream end communicating with the upstream end of said casing, the downstream ends of said compound passageways being separated from one another by a partition which terminates close to the upstream end of said monolithic catalyst, whereby gasses from one of said compound passageways pass through one set of paths of said monolithic catalyst and gasses from another of said compound passageways pass through another set of paths of said monolithic catalyst.

2. An exhaust-gas purifier according to claim 1, in which said engine has four cylinders, and in which the two individual passageways which communicate with the same compound passageway communicate with engine cylinders which are non-consecutive in firing order.

3. An exhaust-gas purifier according to claim 1, in which said exhaust manifold is a casting and said casing is a casting secured to said exhaust manifold.

4. An exhaust gas purifier according to claim 1, in which said elastic sealing means comprise elastic ring members of knitted wire mesh.

5. An exhaust gas purifier according to claim 1, in which an elastic member of stainless steel wires is cylindrically wound around said monolithic catalyst.

* * * * *